United States Patent [19]

Scott et al.

[11] 4,321,286

[45] Mar. 23, 1982

[54] PROCESS FOR PRODUCING TRANSFER RIBBONS

[75] Inventors: Michael A. Scott, Huntington; Albert E. Brown, Glen Cove, both of N.Y.

[73] Assignee: International Business Machines Corporation, Armonk, N.Y.

[21] Appl. No.: 57,068

[22] Filed: Jul. 12, 1979

[51] Int. Cl.[3] ..... B41M 5/00; B41M 5/02

[52] U.S. Cl. ..... 427/152; 400/241.2; 427/141; 427/153; 427/209; 427/387; 427/393.5; 427/397.7; 427/412.1; 427/412.5; 428/447; 428/480; 428/483; 428/914; 428/315.5; 428/321.3

[58] Field of Search ..... 400/241.1, 241.2, 241.4; 427/141, 152, 146, 148, 150, 151, 153, 195, 209, 372.2, 387, 402, 393.5, 397.7, 407.1, 412.1, 412.5; 428/307, 447, 914, 195, 207, 306, 341, 480, 483

[56] References Cited

U.S. PATENT DOCUMENTS

| | | | |
|---|---|---|---|
| 3,037,879 | 6/1962 | Newman et al. | 428/914 |
| 3,689,301 | 9/1972 | Scott | 428/914 |
| 4,016,321 | 4/1977 | McIntyre | 400/241.4 X |

FOREIGN PATENT DOCUMENTS

| | | | |
|---|---|---|---|
| 52-18770 | 2/1977 | Japan | 428/447 |

*Primary Examiner*—Bruce H. Hess
*Attorney, Agent, or Firm*—Thomas L. Tully

[57] ABSTRACT

Pressure-sensitive transfer ribbons of the squeeze-out or reusable type having a thin, flexible plastic film foundation having bonded thereto a microporous resinous ink layer containing pressure-exudable liquid ink and designed for use in high speed printing or impact machines in which the ribbon is moving during impact. The invention comprises the formation of a thin friction-reducing or slip-permitting layer of silicone polymer on the rear or impact surface of the film foundation in order to reduce the friction between the moving printing element and the moving film foundation and prevent grabbing of the film foundation and breakdown of the bond between the film foundation and the ink layer.

6 Claims, No Drawings

PROCESS FOR PRODUCING TRANSFER RIBBONS

BACKGROUND OF THE INVENTION

Transfer elements having microporous ink layers containing pressure-exudable flowable ink are well-known, and reference is made to U.S. Pat. Nos. 3,037,879 and 3,689,301 as representative thereof.

Such transfer elements were originally developed for typewriter use in place of conventional wax-base carbon papers since the microporous ink layer did not transfer under a single impact pressure, as is the case with one-time wax carbon layers, but rather functioned by exuding pressure-flowable ink from the microporous sponge binder material each time the transfer element was subjected to typing pressure, even over the same area.

More recently, it has been found desirable to use such transfer elements in ribbon form in high speed typing or impact printing machines and bar code printers which operate at such speeds that conventional one-time transfer elements are impractical since they are used up so quickly that they must be replaced at frequent intervals. The microporous transfer ribbons may be reversed and reused several times, depending upon the printing machine, or more commonly, are transported in a continuous creeping motion through the machine so that each area of the ribbon is subjected to several overlapping impacts before it passes the impact station as the machine transfers characters at a rate of up to twenty per second —see Xerox U.S. Pat. Nos. 3,954,163 and 4,037,706, for example.

An important problem has been encountered during the use of such microporous transfer ribbons in high speed printing machines and bar code printers in which the ribbon is in constant motion during impact, i.e., it is hit by the type element or print face without any stoppage of movement of the ribbon —see U.S. Pat. No. 3,924,532. The copy sheet may also be in movement in the same direction or in a direction perpendicular to the direction of movement of the ribbon. In any event, the ribbon is moving slowly through the impact station when it is engaged by the typing face and, even though the period of engagement may be momentary, the typing face embosses and can snag the rear face of the ribbon and cause a breakdown of the bond between the film foundation and the ink layer supported thereby. This breakdown results in a transfer of solid particles of the microporous resin structure of the ink layer to the copy sheet, rather than the desired exudation of the ink from the microporous resin structure, and the production of spotty and dirty images on the copy sheet.

Also, particularly in the case of narrow ribbons, the frictional engagement or snagging of the moving ribbon by the type face can result in a breakage of the ribbon.

It was felt that such problems were inevitable with the use of microporous transfer ribbons in high-speed impact and printing machines, due to the spongy nature of the ink-exuding microporous resinous layer and the high pressures exerted by the type element, print hammer or bar code fonts.

SUMMARY OF THE INVENTION

The present invention is based upon the discovery that although smooth plastic film foundations, particularly embossment-resistant films such as tensilized polyethylene terephthalate, have an exceptionally smooth, rear surface, the performance of film-base transfer elements of the microporous, ink-releasing type in which speed printing machines can be improved substantially by forming on the rear impact surface of such transfer elements an exceptionally thin, hard, slip-permitting layer of a friction-reducing composition comprising a cured, polymerized silicone polymer.

We have discovered that although microporous, ink-releasing layers must be compressible in order to exude the flowable ink therefrom, such compression will not result in a grabbing or snagging of the transfer ribbon during high speed operation if the rear impact surface of the polyester film foundation is coated with a thin continuous layer of a polymerizable silicone composition followed by curing said composition to form a thin, continuous, slip-permitting layer which reduces the effects of friction between the impact elements, such as type faces, and the impacted surface of the transfer ribbon, thereby permitting the impact element to engage and disengage the back of the ribbon smoothly even though the ribbon is in motion during impact. Thus the impact element is able to engage the rear surface of the moving transfer ribbon, slip into transfer contact position and slip back out of engagement without loss of relative motion therebetween, i.e., the impact element does not snag or grab the polyester film foundation or cause such distortion or embossing thereof as can result in a rupture or breakdown of the bond between the film foundation and the microporous ink layer. Thus the ink layer functions in its intended manner by exuding liquid ink to the copy sheet to form images which are uniform and sharp, and which are clean to the touch since they are absorbed into the copy sheet surface and are free of any solid particles of the microporous resinous structure.

The slip-permitting curable silicone polymer back coating compositions, useful according to the present invention, have the following essential characteristics. They must have a sufficiently low viscosity, in the presence of their coating solvent, that they are capable of being applied as a thin, continuous coating which does not substantially increase the thickness of the film foundation and, therefore, does not reduce the sharpness or quality of the images typed. Also, they must be curable at temperatures below about 225° F. when heated for less than about one minute so as not to damage the film foundation. Moreover, the coating solvent must be one to which the particular film foundation is inert. Finally, the cured slip-permitting coating must be exceptionally thin, hard and inert with respect to the microporous ink layer, particularly the pressure-exudable ink present therein, so that the backing coating does not absorb or contaminate the ink layer when the transfer element is collected on a spool or roller.

The preferred back-coating compositions of the present invention are based upon polymerizable liquid silicone polymers, such as those commercially-available from Dow Corning Company under the registered trademark Syl-off 294, which consists of a 40% solution of the liquid silicone in a high flash naphtha solvent and has a viscosity of 4000 cps at 25° C. Such liquid polymers are used together with a fact cure additive, such as a functional polysiloxane available from Dow Corning under the designation DC C4-2123 and/or a catalyst, such as dibutyl tin diacetate available from Dow Corning under the designation DC XY-176.

In addition to the liquid silicone film-former, the present coating compositions also contain a major amount by weight of the inert coating solvent, such as heptane, and, preferably, a small amount of a second volatile solvent, such as isopropyl alcohol, which is hygroscopic and increases the pot life by tying up any absorbed water.

It should be understood that other low molecular weight liquid silicone monomers and pre-polymers can also be used, the essential requirement being that such polymerizable or curable materials are capable of being dissolved in an amount equal to from about 1.5 to about 10% by weight, based upon the total weight of the coating composition, to provide a water-thin composition having a viscosity between about 18 and 26 seconds measured by a number 2 Zahn cup, are capable of being applied as a thin, continuous wash coating over the back of the film foundation and cured at a temperature below about 225° F. in less than one minute to form the desired exceptionally thin, hard, continuous solid slip-permitting back coating have a weight of from about a few ounces per ream, sufficient to form a continuous coating, up to about one pound per ream, a ream being equal to 500 sheets which are 25 inches by 38 inches in dimension, i.e., 3300 square feet.

Most preferably, the present curable silicone polymer compositions contain from about 2½% to 5% solids, have a Zahn viscosity between about 20 and 24 seconds as measured by a number 2 cup, are applied in amounts between about 5 and 11 ounces per ream and are curable at temperatures below about 200° F. when heated for less than about 45 seconds.

Also, the silicone back coatings can be applied by means of gravure printing techniques, using a number 100 or 110 gravure printing cylinder.

For purposes of simplification, reference is made to U.S. Pat. Nos. 3,689,301 and 3,037,879, the disclosures of which are incorporated herein by reference, for their disclosure of suitable film-base microporous, reusable transfer elements which may be used according to the present invention.

The following example is given by way of illustration and should not be considered limitative:

EXAMPLE

| Ingredients | Parts by Weight |
|---|---|
| Syl-off 294 | 7.5 |
| Functional polysiloxane | 0.3 |
| Dibutyl tin diacetate | 0.3 |
| Isopropyl alcohol | 3.0 |
| Heptane | 88.9 |

The above ingredients, except for the dibutyl tin diacetate, are mixed for about fifteen minutes to form a uniform thin solution. Next, the dibutyl tin diacetate catalyst is added and mixing is continued for about ten minutes to form the coating composition which has a pot life of about eight hours at ordinary room temperature.

The formed composition is applied as the thinnest possible continuous liquid coating to one surface of a thin film web, such as tensilized polyethylene terephthalate polyester (Mylar T), having a thickness of about 0.3 mil (0.0003 inch) and the coated film is heated to a temperature of about 180° F. for about thirty seconds to evaporate the solvents and form the cured slip-permitting back coating having a weight of about one-half pound per ream.

Thereafter, the opposite surface of the film is coated with a thin layer of an undercoating composition, such as one based upon a vinyl resin, a linear polyester or a polyurethane, and then with a thin layer of a microporous resinous ink layer composition, such as disclosed in U.S. Pat. Nos. 3,689,301 or 3,037,879. For example, the film foundation may be coated on said opposite surface with a thin layer comprising 1 part by weight of a linear polyester resin, such as Vitel resin 5545, about 0.1 part by weight of a vinyl resin, such as Vinylite VYHH resin copolymer, a solvent such as methyl ethyl ketone and filler, if desired. The layer is dried by evaporation of the solvent to leave a continuous thin bonding layer having a thickness between about 0.00005 inch and 0.0001 inch on the Mylar T surface.

Thereafter, an ink composition comprising the following ingredients is mixed in a ball mill and ground together until highly dispersed to form a uniform coating composition:

| Ingredients | Parts by Weight |
|---|---|
| Vinyl chloride-vinyl acetate copolymer (Vinylite VYHH) | 12.0 |
| Mineral oil | 7.0 |
| Lanolin | 7.0 |
| Alkaline blue pigment toner | 1.0 |
| Untreated carbon black pigment | 6.0 |
| Inert filler | 2.0 |
| Sulfonated vegetable oil (wetting agent) | 1.5 |
| Naphtholite vehicle | 2.5 |
| Methyl ethyl ketone solvent | 61.0 |
| | 100.0 |

The ink coating composition is applied over the bonding layer on the film foundation as a uniform thin layer in an in-line coating operation during a single pass of the film through the coating machine. This is preferred, since the linear polyester bonding layer is somewhat sticky unless filler is included to reduce tack. The methyl ethyl ketone is evaporated first and then the Naphtholite is evaporated to form the ink layer having a thickness of from about 0.0005 inch up to about 0.0008 inch, preferably about 0.0006 inch. The ink layer comprises a microporous, pressure-non-transferable network of the vinyl copolymer containing within the pores thereof a pressure-exudable ink having a high viscosity comprising the mineral oil, lanolin, wetting agent and pigments.

The coated, dried film is then cut into ribbons of the desired length and width for use in the high speed electronic typewriters and printing machines discussed hereinbefore, conventional widths being ¼ inch, 5/16 inch, 1 inch and 1⅛ inch, depending upon the requirements of the machine. The ribbons produced are compared with control ribbons which are prepared in exactly the same manner from identical films and compositions, the only difference being the presence of the cured silicone layer on the rear surface of the ribbons produced according to the present invention, whereas the rear surface of the control ribbons is uncoated.

The treated ribbon and the control ribbon are used successively on both an Intermec Machine which is a bar code printing machine commercially-available from Interface Mechanisms, Inc., and on a Data 100 Printer which is a high-speed character and universal bar code printer commercially-available from Northern Telecon Communications. Both ribbons performed without breakage. However, the rear surface of the control ribbon exhibited substantially greater embossment and the images printed on the copy sheet in both the Intermec and Data 100 machines were spotty and contained solid particles of the microporous resinous structure which broke away from the ink layer during the typing operation. Such particles smeared over the copy sheet when the copy images were rubbed lightly with the fingertips.

Conversely, the rear surface of the ribbon produced according to the present invention showed only slight evidence of embossment and the images produced on the copy sheet in both the Intermec and Data 100 machines were sharp, uniform in color intensity and resistant to smudging or smearing when rubbed lightly with the fingertips. The images were free of solid particles of the microporous resinous structure of the ink layer and had the appearance and properties of images printed from a fabric ribbon.

While the use of tensilized polyester film is a preferred foundation for the present transfer elements, nontensilized polyethylene terephthalate polyester film may also be used as well as other films such as polyethylene, polypropylene, nylon, and the like. The slip-permitting backing layer reduces the embossment and stretching problems normally encountered with the use of such films.

Variations and modifications will be apparent to those skilled in the art in the light of the present disclosure and within the scope of the present claims.

We claim:

1. Process for producing pressure-sensitive transfer elements which have improved resistance to embossment and breakdown of the ink layer by a type face and resistance to being snagged and torn when used in high-speed typing and printing machines comprising the steps of:

(a) coating one side of a thin flexible smooth plastic film foundation with a thin wash coating comprising from about 1.5% to 10% by weight of a polymerizable silicone composition dissolved in a volatile organic solvent which is inert to said smooth plastic film foundation;

(b) heating to a temperature below about 225° F. for less than one minute to provide a thin, substantially continuous slip-permitting, friction-reducing dried silicone layer on said film foundation, said silicone layer having a weight of up to about one pound per 3300 square feet of said film foundation and not substantially increasing the thickness of said film foundation; and (c) applying to the opposite side of said plastic film foundation a thin microporous resinous ink layer which is adapted to exude ink to a copy sheet in image from under the effects of imaging pressure exerted against said one side of said foundation by the impact element of a high-speed typing or printing machine, said slip-permitting, friction-reducing cured silicone layer being inert with respect to said microporous ink layer and reducing the effects of friction between said impact element and said transfer element to prevent separation of said microporous resinous ink layer from said film foundation and to prevent snagging and tearing of said thin film foundation.

2. Process according to claim 1 in which said film foundation comprises a polyethylene terephthalate film foundation.

3. Process according to claim 1 or 2 in which a thin, resinous bonding layer is applied to the said opposite side of said film foundation prior to the application of the microporous resinous ink layer thereover.

4. Process according to claim 1 or 2 in which the polymerizable silicone composition comprises a functional polysiloxane curing agent and a catalyst.

5. Process according to claim 4 in which said silicone layer is formed by heating to a temperature less than about 200° F. for less than about 45 seconds.

6. Process according to claim 4 in which said silicone composition is applied in an amount sufficient to provide a dried silicone layer having a weight of from about 5 ounces to 11 ounces per ream of said film.

* * * * *